United States Patent [19]

Canavesi et al.

[11] Patent Number: 4,610,120

[45] Date of Patent: Sep. 9, 1986

[54] SEAL AGAINST PENETRATION OF WATER INTO MASONRY

[75] Inventors: Pietro L. Canavesi, Sementina; Peter Zwicky, Sarnen, both of Switzerland

[73] Assignee: Gunimperm S.A., Castione, Switzerland

[21] Appl. No.: 581,044

[22] Filed: Feb. 17, 1984

[51] Int. Cl.[4] ..... E02D 31/00; E21D 11/38

[52] U.S. Cl. ..... 52/511; 24/586; 24/587; 24/697; 52/169.14; 405/150

[58] Field of Search ..... 405/53, 132, 150, 151, 405/152, 153; 24/586, 587, 662, 697; 160/383, 385; 52/169.14, 273, 511

[56] References Cited

U.S. PATENT DOCUMENTS

| | | | |
|---|---|---|---|
| 2,097,988 | 11/1937 | Ross et al. | 24/587 X |
| 3,745,736 | 7/1973 | Fischer | 52/511 |
| 3,793,795 | 2/1974 | Annand | 52/169.14 X |
| 4,020,884 | 5/1977 | Jadot | 24/587 X |
| 4,239,416 | 12/1980 | Borca et al. | 405/53 |
| 4,371,288 | 2/1983 | Borca et al. | 405/150 X |
| 4,497,093 | 2/1985 | Haberkorn | 24/586 |

FOREIGN PATENT DOCUMENTS

| | | | |
|---|---|---|---|
| 642639 | 9/1950 | United Kingdom | 160/385 |

*Primary Examiner*—David H. Corbin

*Attorney, Agent, or Firm*—Young & Thompson

[57] ABSTRACT

A flexible sealing layer (1) is provided for the collection and lateral drainage of existing water, especially in tunnel constructions. This sealing layer comprises unidirectional, continuously extending webs (3) arranged so that they project toward the water-permeable substrate, thus preserving the required space (D) for water drainage between the layer (1), in close contact with the substrate, and the substrate (U) proper. The webs (3) are of an arrow-like configuration (3') at the end projecting from the sealing layer. The sealing layer is fixed in place by locking or hooking the webs of the sealing layer into complementarily fashioned webs (7, 7') of fixing elements (4), which latter have been previously attached to the substrate (U) by means of nails (5), for example. This type of seal proves to be advantageous, in particular, if the tunnel tube is curved.

2 Claims, 4 Drawing Figures

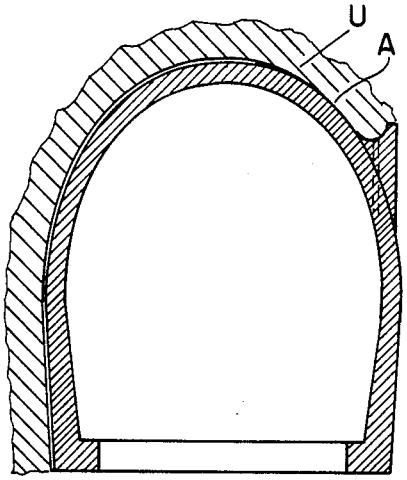
FIG.1
FIG.4
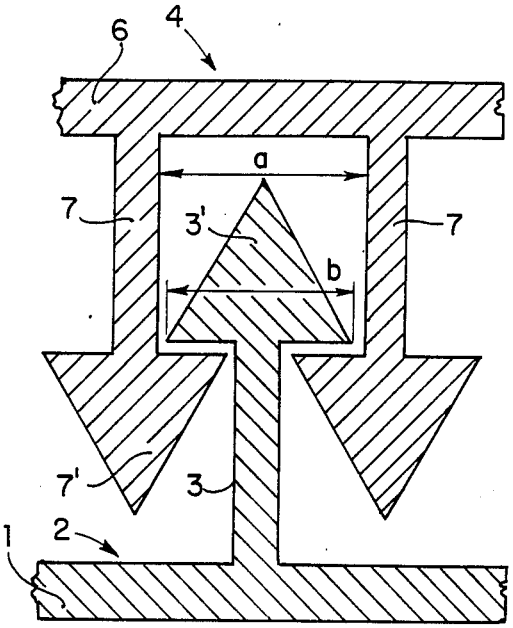
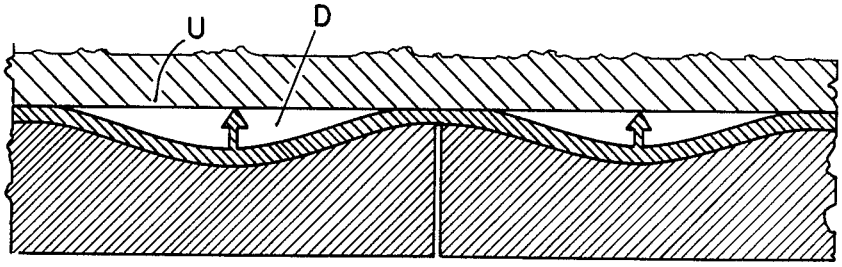
FIG.2
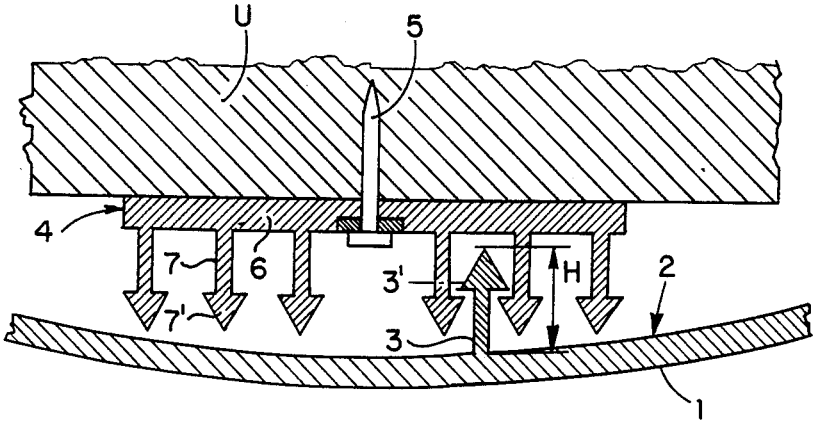
FIG.3

SEAL AGAINST PENETRATION OF WATER INTO MASONRY

The invention relates to a seal against penetration of water into masonry, usable for waterproofing and simultaneous drainage of existing water in tunnel constructions.

Sealing arrangements for masonry, especially for railway and road constructions with a tunnel, wherein the requirement of a dry tunnel must absolutely be met, are conventional. In particular, the state of the art includes covering the tunnel arch with impermeable panels, thus, for example, with asphalt panels, roofing felt, or also with sheets manufactured from plastic material. In these arrangements, the existing water is conducted along the path of least resistance from the arch over the impermeable sealing layer into catch basins of the arch and subsequently into drainage ditches in the tunnel floor.

The seals or drainage layers according to the prior art, especially in the presence of expansive rock, are very expensive in their manufacture and installation. Besides, there is the danger that these seals or drainage layers are compressed in case of even a minor pressure transmission from the arch or of the concreting pressure of the inner lining on the permanent supporting system so that the desired sealing effect fails and/or the required drainage space is restricted or is even entirely lost.

Therefore, the invention is based on the object of providing a construction making it possible in a simple way and with economically advantageous means to produce a seal and simultaneously a drainage layer, and attach same to the tunnel shell, in such a way that the drainage space existing between the arch and the tunnel lining remains preserved even under considerable pressures that may occur in the tunnel structure, and that furthermore the installation of the seal, even if the direction of the tunnel is not linear, can be accomplished without appreciable additional work. Finally, it is an object of the invention to provide a seal and moreover a mounting of the seal to the substrate consisting of pneumatically applied concrete, shell concrete, or rock which is advantageous in price and additionally ensures numerous and various usage possibilities.

In order to attain this object, it is proposed according to the invention to start with a flexible sealing layer exhibiting first members projecting from at least one side surface, at least one fixing element for the layer material being permanently attachable to the substrate from which the water emanates, this fixing element exhibiting second members associated with the first members, wherein, for the respective mounting of the layer material to the fixing elements, the members pertaining to the layer material can be affixed to and/or locked into or hooked onto the members pertaining to the fixing element, or vice versa.

The sealing arrangement for conducting the process is characterized in that it comprises a sealing layer wherein, from one of its surfaces and at regular intervals, coherent and parallel-extending members project in the form of webs, which webs, when the seal is installed, are oriented in the direction of the substrate of the construction.

The invention furthermore concerns the use of the seal in the building of a tunnel for the collection and drainage of water coming from the substrate, the arch, or from the tunnel shell in general.

Suitably, the sealing layer, together with the weblike formations with an arrow-like end, is manufactured from synthetic resin material and by means of extrusion.

The sealing layer can be advantageously attached and/or locked or hooked into place by means of fixing elements permanently attachable to the water-permeable substrate.

Additional advantages and details of the invention can be seen from the folllowing description of the practical examples schematically illustrated in the drawing wherein:

FIG. 1 shows schematically the profile of a tunnel with a seal indicated therein which has been mounted in various ways;

FIG. 2 shows on an enlarged scale the seal, introduced between the substrate and the tunnel lining, with the hollow space for water drainage;

FIG. 3 shows in detail the seal mounted to the tunnel shell;

FIG. 4 shows on an enlarged scale a detail of FIG. 3, representing the mutual interlocking engagement of a web pertaining to the seal into two neighboring webs of a fixing element.

The seal A illustrated in the figures is formed of an essentially planar sealing layer 1. Coherent and parallel-extending webs 3 with arrow-like ends 3' project in this arrangement from one of the surfaces 2 of the sealing layer at mutually regular spacings. Advantageously, the sealing layer or sheet layer 1 is made together with the webs 3 continuously, for example by extrusion, and from a synthetic resin material, especially of a plastic material. The thickness of the sheet is advantageously within the limits of 1.5–2.5 millimeters whereas the height H of the webs 3, including their tip 3', is about 5–8 millimeters. The material used for this purpose has the property of being excellently weldable, especially with respect to mutual heat-sealing of two layers with the aid of hot air or heated V-blade. It is possible in this connection, as is conventional, to weld together the lateral edges of two sheet sections, previously brought into close mutual contact, with a strip overlapping both of these sections, or the lateral edges of the sheet sections are manufactured without the webs 3 so that the overlapping sheet edges can thus be perfectly welded together.

Advantageously, the invention furthermore provides a fixing element 4 for the seal, designed in the form of relatively small, convenient plates of about $8\times8$ cm lateral length, or in the form of elongated strips. These are then mounted directly to the substrate U with the aid of nails 5 or similar fixing means.

According to FIGS. 3 and 4, the fixing element 4 is made of a material equivalent to the actual seal. In analogy to the above-described seal, the fixing element 4 also consists respectively of a base panel 6 from which project several rows of uninterrupted webs 7 terminating in an arrow-shaped end 7'. The latter webs 7 and arrow-like or triangular ends 7' correspond substantially to the configuration of the webs 3 described with respect to the seal proper; however, the webs pertaining to the mounting panels or strips are arranged at a mutually close spacing a. The dimension of the mutual spacing a (FIGS. 3 and 4) between two opposed and parallel-extending web surfaces of the mounting means is only somewhat larger than the total basal width b of the triangular arrows of the sealing sheet. Thereby, with manual exertion of pressure in the zone of the web 3 of the sealing layer 1, the arrowlike ends 3' and 7' are mounted and/or are locked in place or hooked together. As a consequence, a detachment of the seal 1 from the fixing element 4 becomes practically impossible. It is self-evident that a fixing element, contrary to the arrangement with respectively three parallel-extending webs as shown in FIG. 4, can possess a plurality of additional webs. The use of mounting plates or strips with optionally multiple anchoring 5 thereof to the substrate U proves advantageous, in particular, if the direction of the tunnel is not linear. In this case, respectively two associated webs of a fixing element and thus in each case the required contact point for the sealing and water-draining sheet layer with the tunnel shell, are provided for the spirally cut-to-size sealing means, especially for its correspondingly spirally extending drainage webs.

According to a preferred embodiment of the seal, the drainage or spacer webs, serving simultaneously for locking into or hooking onto correspondingly designed webs of a fixing element, are fashioned separately from the sealing layer and are only subsequently applied to the sealing layer proper to be detachable or to be permanently affixed.

Also, the provision is made to provide the surface of the seal facing away from the webs with a colored cover layer.

We claim:

1. In combination with a masonry construction having an exposed surface, fixing elements secured to said exposed surface, and a waterproof sheet secured to said fixing elements, each of said fixing elements having a plurality of parallel webs thereon extending away from the masonry construction and terminating in arrow-like ends, there being a sufficient plurality of said webs to define a plurality of parallel channels between adjacent said webs, and at least one web on the sheet extending in the direction of the masonry construction and terminating in an arrow-like end having a width greater than the distance between adjacent said heads on the webs of said fixing elements but less than the distance between adjacent said webs of said fixing elements, whereby said sheet can be assembled to said fixing elements by introduction of the arrow-like end on the sheet between any adjacent pair of said ends on the fixing elements, thereby to retain said end on the sheet in any of said plurality of channels of said fixing elements, the material of said webs on said fixing elements being sufficiently resilient to permit the penetration of said end on said sheet into any said channel.

2. Structure as claimed in claim 1, said fixing elements being of one-piece plastic construction and said sheet being of one-piece plastic construction.

* * * * *